US008602040B2

(12) United States Patent
Haddad

(10) Patent No.: US 8,602,040 B2
(45) Date of Patent: Dec. 10, 2013

(54) LIP SUBSTRATE APPLICATOR KIT

(71) Applicant: Violent Lips, LLC, Beverly Hills, CA (US)

(72) Inventor: Jeffrey Paul Haddad, Beverly Hills, CA (US)

(73) Assignee: Violent Lips, LLC, Beverly Hills, CA (US)

( * ) Notice: Subject to any disclaimer, the term of this patent is extended or adjusted under 35 U.S.C. 154(b) by 0 days.

(21) Appl. No.: 13/678,127

(22) Filed: Nov. 15, 2012

(65) Prior Publication Data

US 2013/0068246 A1 Mar. 21, 2013

Related U.S. Application Data

(63) Continuation of application No. 13/296,507, filed on Nov. 15, 2011, now Pat. No. 8,333,205.

(60) Provisional application No. 61/476,197, filed on Apr. 15, 2011, provisional application No. 61/529,790, filed on Aug. 31, 2011.

(51) Int. Cl.
*A45D 40/30* (2006.01)

(52) U.S. Cl.
USPC ..... 132/320; 132/319; 132/200

(58) Field of Classification Search
USPC ..... 132/319, 320, 285; 401/9, 11; 428/40.1–42.3; 424/400, 401, 64; 156/230, 239, 240, 63; 128/857, 859, 128/861; 206/581, 575, 1.9, 484, 459.5
See application file for complete search history.

(56) References Cited

U.S. PATENT DOCUMENTS

| | | | | | |
|---|---|---|---|---|---|
| 3,485,251 | A | * | 12/1969 | Brunet | 132/216 |
| 4,611,611 | A | | 9/1986 | Beal, Jr. | |
| 4,783,350 | A | | 11/1988 | DeMatteo et al. | |
| 4,865,057 | A | * | 9/1989 | Braun | 132/201 |
| 5,070,892 | A | * | 12/1991 | Trematerra | 132/73 |

(Continued)

FOREIGN PATENT DOCUMENTS

| | | | |
|---|---|---|---|
| JP | 2002-300333 | A | 10/2000 |
| JP | 2009-195318 | A | 9/2009 |

OTHER PUBLICATIONS

KIPO International Search Report (ISR) and Written Opinion in co-pending application PCT/US2011/060740.

(Continued)

*Primary Examiner* — Robyn Doan
*Assistant Examiner* — Tatiana Nobrega
(74) *Attorney, Agent, or Firm* — Lance M. Pritikin, Esq.

(57) ABSTRACT

A lip substrate applicator kit includes upper and lower applicators adapted to facilitate the application of lip substrates onto the upper and lower lips of a wearer. The lip substrates typically includes an image layer featuring one or more of a variety of colors, graphic designs and text elements. Edges of the applicators may be pre-cut to ensure that the applied substrate presents a symmetrical and clean appearance at the vermillion borders of the wearer's lips. Each applicator includes an adhesive layer, a peel layer and a guide layer. The guide layer has a guide pattern configured to aid a user in trimming excess portions from the applicator generally along a curved pathway, so that the substrate may be customized to fit the lips of the wearer. The kit may include a die cut applicator sheet from which the upper and lower applicators are die cut, suspended and detachable.

23 Claims, 3 Drawing Sheets

(56) References Cited

U.S. PATENT DOCUMENTS

| | | | | |
|---|---|---|---|---|
| 5,765,231 | A | 6/1998 | Leonard et al. | |
| 5,832,936 | A * | 11/1998 | Pruchnic et al. | 132/73 |
| 5,928,797 | A | 7/1999 | Vineberg | |
| 5,942,065 | A | 8/1999 | Biggs et al. | |
| 5,958,560 | A | 9/1999 | Ewan | |
| 6,035,867 | A * | 3/2000 | Barrick | 132/320 |
| 6,042,881 | A | 3/2000 | Ewan | |
| 6,074,721 | A * | 6/2000 | Moore et al. | 428/42.1 |
| 6,161,554 | A * | 12/2000 | Dunlap-Harris | 132/216 |
| 6,264,786 | B1 | 7/2001 | Crommett | |
| 6,299,967 | B1 | 10/2001 | Collins et al. | |
| 6,598,608 | B1 * | 7/2003 | Downey | 132/200 |
| 6,632,499 | B1 | 10/2003 | Marks, III et al. | |
| 6,793,999 | B2 | 9/2004 | Wittmeyer, Jr. | |
| 6,977,106 | B2 | 12/2005 | Billings | |
| 7,011,401 | B2 | 3/2006 | Markey, III | |
| 7,165,559 | B1 | 1/2007 | Goodman | |
| 7,517,571 | B2 | 4/2009 | Funke et al. | |
| 7,927,680 | B2 | 4/2011 | Marshall | |
| 2005/0214495 | A1 * | 9/2005 | Thiebaut | 428/40.1 |
| 2005/0232958 | A1 | 10/2005 | Lee | |
| 2005/0255299 | A1 | 11/2005 | Yu | |
| 2006/0013844 | A1 * | 1/2006 | Meriaux | 424/402 |
| 2007/0010776 | A1 | 1/2007 | Price et al. | |
| 2007/0036928 | A1 | 2/2007 | Givens et al. | |
| 2008/0226701 | A1 | 9/2008 | Deignan et al. | |
| 2009/0120565 | A1 * | 5/2009 | Marshall | 156/230 |
| 2009/0151741 | A1 * | 6/2009 | Ngo | 132/216 |
| 2009/0211591 | A1 | 8/2009 | Hwang | |
| 2009/0241981 | A1 | 10/2009 | Dobbler et al. | |
| 2009/0260567 | A1 | 10/2009 | Ozuna et al. | |
| 2009/0272394 | A1 * | 11/2009 | Livacich et al. | 132/200 |
| 2009/0287168 | A1 * | 11/2009 | Mitra et al. | 604/290 |
| 2010/0239619 | A1 * | 9/2010 | Hurwitz | 424/401 |
| 2011/0073125 | A1 | 3/2011 | Iosilevich | |

OTHER PUBLICATIONS

Randy Schueller; "Temporary Tattoo"; published at Madehow.com, vol. 4, Feb. 5, 2006; viewable at http://www.madehow.com/Volume-4/Temporary-Tattoo.html.

* cited by examiner

LIP SUBSTRATE APPLICATOR KIT

RELATED APPLICATIONS

This application is a continuation of U.S. patent application Ser. No. 13/296,507 filed Nov. 15, 2011, which claims the benefit of U.S. Provisional Application No. 61/476,197, filed on Apr. 15, 2011, and U.S. Provisional Application No. 61/529,790, filed on Aug. 31, 2011, the contents of each of which are incorporated by this reference in their entirety for all purposes as if fully set forth herein.

TECHNICAL FIELD

The present invention relates generally to kits and methods for securing articles to human lips, particularly where such articles are intended to perform a cosmetic or decorative role, or to deliver substances to the lips over an extended period of time.

BACKGROUND

Lip cosmetics have been used since ancient times. They are commonly used to accentuate the natural color of the lips, thereby increasing the sexual attractiveness of the wearer. They may also be used to provide a more fashionable, prominent or eccentric appearance. Conventional lip cosmetics typically take the form of oils, waxes and emollients, and generally present only a single, solid color. The average wearer does not have the time, budget or expertise to use conventional lip cosmetics to produce the appearance of complex colorations or graphic designs. Moreover, conventional lip cosmetics such as lipsticks can rapidly wear or smear due to common activities such as eating, drinking and kissing. What is needed is a cost-effective and easy-to-apply lip cosmetic application means which can provide lips with a limitless set of colors and graphic patterns, ensure a longer-lasting and more durable result, and present clean, symmetrical edges that follow the natural borders of the wearer's lips.

SUMMARY

One or more deficiencies of the prior art are addressed by a lip substrate applicator kit, which typically includes an upper applicator and a lower applicator. The upper and lower applicators may each be die cut, suspended and detachable from a single die cut applicator sheet. In certain embodiments, a single die cut applicator sheet may include multiple upper and lower applicators.

An upper applicator may be flexible and have an upper edge and an opposing upper waterline edge, both of which may extend between an upper right end and an upper left end. The upper edge may be generally arcuate, substantially symmetrical about an upper axis and have a concave portion substantially symmetrical about the upper axis. The upper waterline edge may be generally arcuate in the same direction as the upper edge The upper applicator may include an upper lip substrate, an upper adhesive layer an upper peel layer and an upper guide layer. The upper lip substrate may have an upper first face and an upper second face. The upper adhesive layer may be disposed generally at the upper first face. The upper peel layer may be peelably affixed to the upper adhesive layer.

The upper guide layer may have an upper bond face and an upper guide face. The upper bond face may be releasably bonded to the upper second face such that the upper guide layer is releasable from the upper second face upon application of water to the upper guide layer. The upper guide face may include an upper guide pattern arranged as a visual reference to aid a user in trimming excess portions from the upper applicator generally along an upper pathway. The upper pathway may be substantially symmetrical about the upper axis and curved toward the upper edge.

A lower applicator may be flexible and have a lower edge and a lower waterline edge, each of which extends between a lower right end and a lower left end. The lower edge may be generally arcuate and substantially symmetrical about a lower axis. The lower waterline edge may be generally arcuate in the same direction as the lower edge.

The lower applicator may include a lower lip substrate, a lower adhesive layer, a lower peel layer and a lower guide layer. The lower lip substrate may have a lower first face and a lower second face. The lower adhesive layer may be disposed generally at the lower first face. The lower peel layer may be peelably affixed to the lower adhesive layer.

The lower guide layer may have a lower bond face and a lower guide face. The lower bond face may be releasably bonded to the lower second face such that the lower guide layer is releasable from the lower second face upon application of water to the lower guide layer. The lower guide face may include a lower guide pattern arranged as a visual reference to aid a user in trimming excess portions from the lower applicator generally along a lower pathway. The lower pathway may be substantially symmetrical about the lower axis and curved toward the lower edge.

The lip substrates may include image layers which present any number of colors, patterns, graphic designs and text elements. In certain embodiments, the adhesive layers may include glitter particles, and at least portions of the respective lip substrate may be substantially transparent, thereby allowing the glitter particles to be viewable therethrough. In further such embodiments, the image layers may include a mix of opaque portions and transparent portions, thereby presenting more intricate graphic designs with an interspersed glitter effect.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
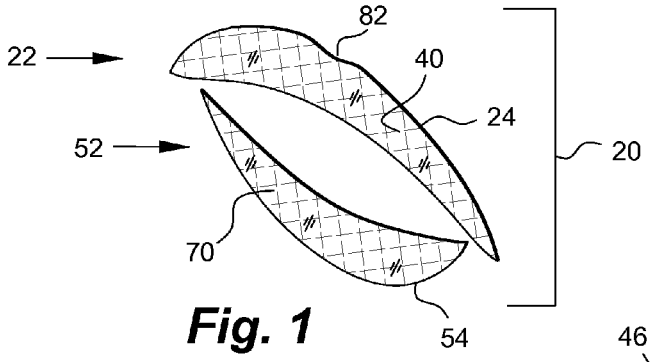
FIG. 1 is a diagrammatic perspective view of an embodiment of a lip substrate applicator kit in accordance with the present invention.

Referring now to the drawings, like reference numerals designate identical or corresponding features throughout the several views. Embodiments of a lip substrate applicator kit are shown generally at 20, and may comprise one or both of an upper applicator 22 and a lower applicator 52. References to "left" and "right" may generally correspond to the perspective of a wearer who is applying the lip substrates to themselves, or to whom the lip substrates are being applied.

Figure 2:
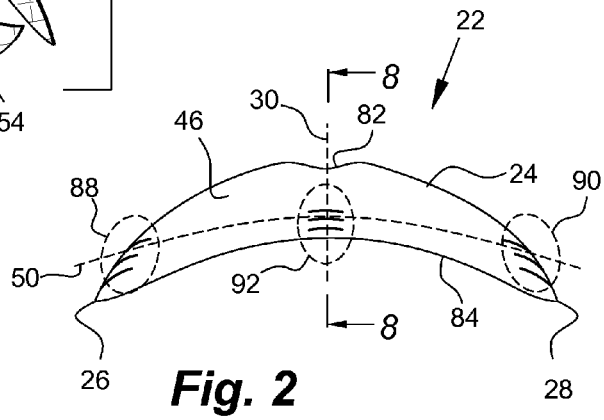
FIG. 2 is a diagrammatic front view of an upper applicator of a lip substrate applicator kit similar to that shown in FIG. 1.
Figure 4:
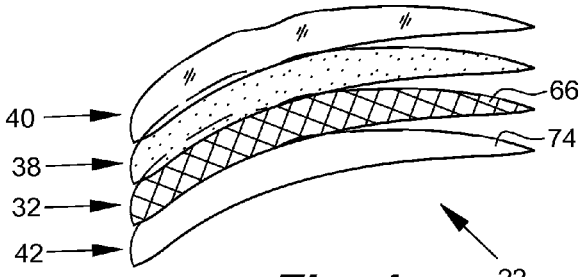
FIG. 4 is a diagrammatic exploded view of the upper applicator shown in FIG. 2.
Figure 8:
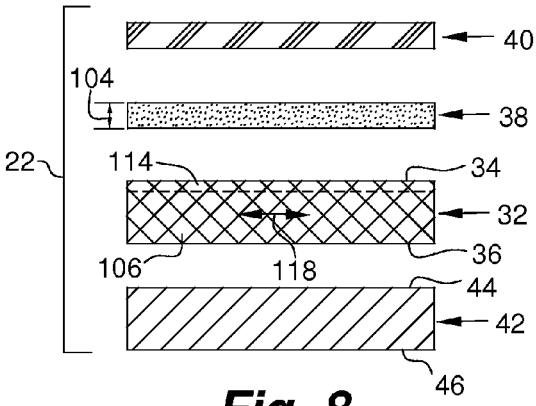
FIG. 8 is a diagrammatic partial cross-sectional view taken along line 8-8 in FIG. 2 in which the upper applicator is shown in exploded state.

Referring to FIGS. 2, 4 and 8 for illustration, the upper applicator 22 is flexible and has an upper edge 24 extending between an upper right end 26 and an upper left end 28. The upper edge 24 may be generally arcuate and substantially symmetrical about an upper axis 30. An upper applicator 22 typically includes an upper lip substrate 32, an upper adhesive layer 38, an upper peel layer 40, and an upper guide layer 42. The upper lip substrate 32 may have an upper first face 34 and an upper second face 36. The upper adhesive layer 38 may be disposed generally at the upper first face 34. The upper peel layer 40 may be peelably affixed to the upper adhesive layer 38. The upper guide layer 42 may have an upper bond face 44 and an upper guide face 46. The upper bond face 44 may be releasably bonded to the upper second face 36 such that upon application of a liquid such as water to the upper guide layer 42, the upper guide layer 42 becomes releasable from the upper second face 36. The upper guide face 46 may include an upper guide pattern arranged to aid a user in trimming (e.g., using scissors) the upper applicator 22 generally along an upper pathway (as shown, for example, at 50). The upper pathway may be substantially symmetrical about the upper axis 30 and may be curved toward the upper edge 24. The guide pattern is generally used as a visual aid by a user to facilitate their trimming of the upper guide layer 22. In embodiments, the upper guide pattern may be arranged generally along the upper pathway 50.

Figure 3:
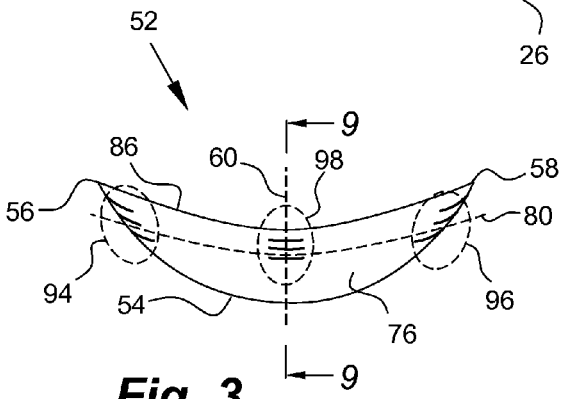
FIG. 3 is a diagrammatic front view of a lower applicator of a lip substrate applicator kit similar to that shown in FIG. 1.
Figure 5:
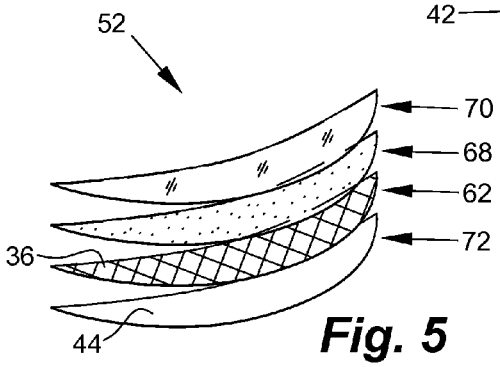
FIG. 5 is a diagrammatic exploded view of the lower applicator shown in FIG. 3.
Figure 9:
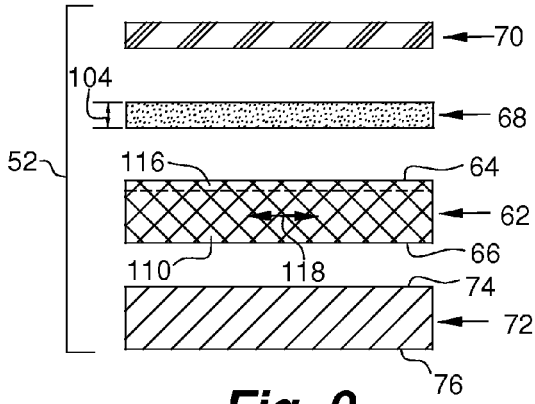
FIG. 9 is a diagrammatic partial cross-sectional view taken along line 9-9 in FIG. 3 in which the lower applicator is shown in exploded state.
Figure 10:
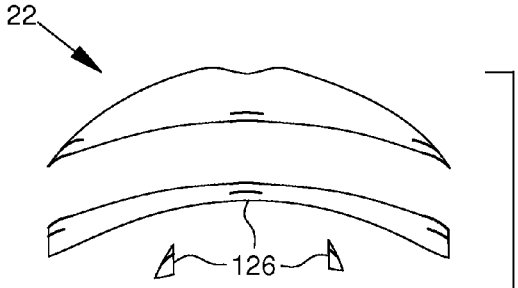
FIG. 10 is a diagrammatic front view in which excess portions have been trimmed from the upper applicator.
Figure 11:
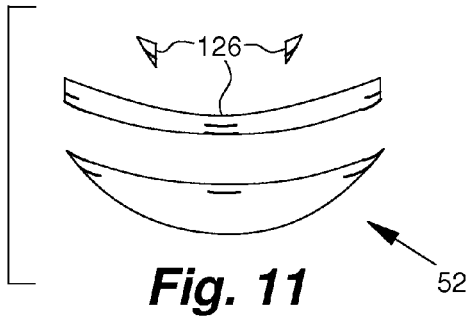
FIG. 11 is a diagrammatic front view in which excess portions have been trimmed from the lower applicator.

Referring to FIGS. 3, 5 and 9 for illustration, the lower applicator 52 is flexible and has a lower edge 54 extending between a lower right end 56 and a lower left end 58. The lower edge 54 may be generally arcuate and substantially symmetrical about a lower axis 60. A lower applicator 52 typically includes a lower lip substrate 62, a lower adhesive layer 68, a lower peel layer 70, and a lower guide layer 72. The lower lip substrate 62 may have a lower first face 64 and a lower second face 66. The lower adhesive layer 68 may be disposed generally at the lower first face 64. The lower peel layer 70 may be peelably affixed to the lower adhesive layer 68. The lower guide layer 72 may have a lower bond face 74 and a lower guide face 76. The lower bond face 74 may be releasably bonded to the lower second face 66 such that upon application of a liquid such as water to the lower guide layer 72, the lower guide layer 72 becomes releasable from the upper second face 66. The lower guide face 76 may include a lower guide pattern arranged as a visual reference to aid a user in trimming (for example, excess portions 126) from the lower applicator generally along a lower pathway (as shown, for example, at 80). The lower pathway may be substantially symmetrical about the lower axis 60 and may be curved toward the lower edge 54. In embodiments, the lower guide pattern may be arranged generally along the lower pathway 80. As illustrated, for example, in FIGS. 2, 7 and 10, an upper guide pattern may generally define a multiplicity of curved upper trim paths extending from proximate the upper right end 26 to proximate the upper left end 28 for aiding a user in evenly trimming at least an excess portion from the upper applicator generally along a selected one of the curved upper trim paths. Each of the curved upper trim paths are typically substantially symmetrical about the upper axis 30 and curved in the same direction as the upper edge 24. As illustrated, for example, in FIGS. 3, 7 and 11, respective analogous structures may be included in a lower guide pattern as well.

In embodiments, the upper and lower guide layers may be comprised of a paper stock backing paper with a silicone release coating applied to it. On top of the release coating is generally a transfer film which may be comprised of, for example, a gelatin, or other polyvinyl materials such as polyvinyl alcohol or polyvinylpyrrolidone (PVP). In embodiments, the release film allows the guide layer to be released from the lip substrate upon the application of water to the guide face of the guide layer. The water typically takes several seconds to soak through the guide layer and trigger the release.

In certain embodiments of a lip substrate applicator kit, the upper edge 24 has a concave portion 82 which is substantially symmetrical about the upper axis 30. This concave portion 82 is intended to closely match the size and shape of a Cupid's bow 136 of the upper lip 130 of a wearer.

In preferred embodiments, the upper lip substrate 32, upper adhesive layer 38 and upper guide layer 42 each have outermost lateral perimeters which are substantially identical in shape and size, and which are in substantial alignment with each other (see, for example, FIGS. 1, 4 and 5). Similarly, in embodiments, the lower lip substrate 62, lower adhesive layer 68 and lower guide layer 72 each have outermost lateral perimeters which are substantially identical in shape and size, and which are in substantial alignment with each other. This preferred adaptation helps ensure that the person applying the lip substrates is able to accurately align the upper edge 24 and lower edge 54 to the upper vermilion border 120 and lower vermilion border 128, respectively. As a result, the corresponding edges of each lip substrate end up being applied in the proper position and alignment on the respective lip.

In certain embodiments of a lip substrate applicator kit 20, the upper applicator 22 has an upper waterline edge 84 disposed generally opposite of the upper edge 24 and extending between the upper right end 26 and the upper left end 28. The upper waterline edge 84 is typically generally arcuate in the same direction as the upper edge 24. In the same or further embodiments, the lower applicator 52 has a lower waterline edge 86 disposed generally opposite of the lower edge 54 and extending between the lower right end 56 and the lower left end 58. The lower waterline edge 86 is typically generally arcuate in the same direction as the lower edge 54.

In particular embodiments, the upper guide pattern includes an upper right trim guide 88 proximate the upper right end 26, an upper left trim guide 90 proximate the upper left end 28, and an upper center trim guide 92 generally at the upper axis 30. Similarly, the lower guide pattern may include a lower right trim guide 94 proximate the lower right end 56, a lower left trim guide 96 proximate the lower left end 58, and a lower center trim guide 98 generally at the lower axis 60.

In certain embodiments which include the aforementioned trim guides, the upper right trim guide 88, upper left trim guide 90, and upper center trim guide 92 each comprise a multiplicity of trim guide markings (shown, for example, at 100 in FIG. 7) extending at progressively greater distances from the upper waterline edge 84. Correspondingly, the lower right trim guide 94, lower left trim guide 96, and lower center trim guide 98 may each comprise a multiplicity of trim guide markings 100 extending at progressively greater distances from the lower waterline edge 86. These markings allow each individual wearer to more easily determine what portions of the applicator are excess portions (see, for example, at 126) which can be trimmed away prior to applying the lip substrate, thereby resulting in a customized fit for any wearer.

Figure 6:
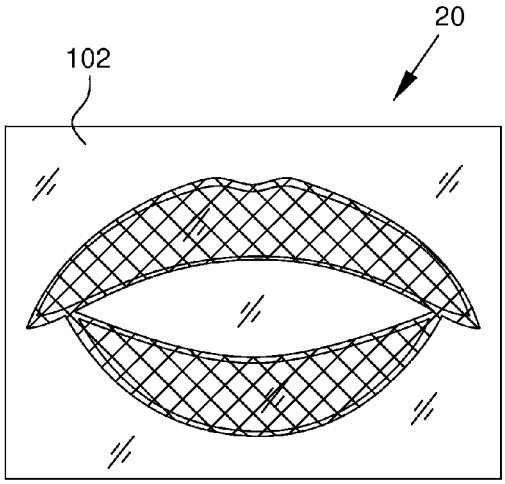
FIG. 6 is a diagrammatic rear view of a lip substrate applicator kit in which the upper and lower applicators are shown die cut and suspendedly detachable from a die cut sheet.
Figure 7:
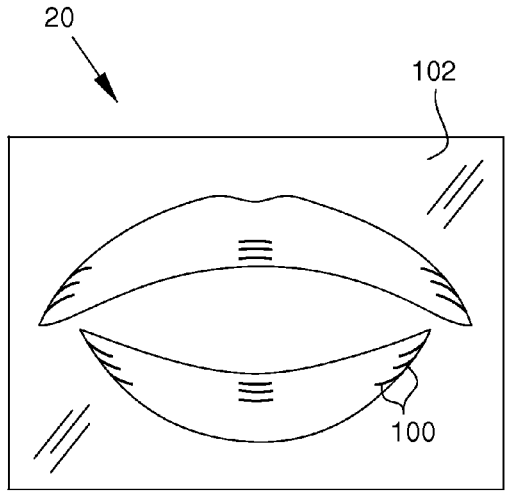
FIG. 7 is a diagrammatic front view of the lip substrate applicator kit shown in FIG. 6.

Turning now to FIGS. 6 and 7 for illustration, a preferred embodiment of a lip substrate applicator kit 20 further comprises a die cut applicator sheet 102 from which the upper applicator 22 and lower applicator 52 are each die cut and suspendedly detachable therefrom. In certain such embodiments, a multiplicity of upper applicators and lower applicators may each be die cut and suspendedly detachable from the same die cut applicator sheet.

Returning to FIGS. 8 and 9 for illustration, in certain embodiments, each of the adhesive layers (upper and lower) have an adhesive thickness 104 which is greater proximate respective right ends and left ends than proximate their respective axis. This helps the upper or lower lip substrate remain affixed to the lip to which it is applied, largely by compensating for the fact that there is less contact surface area available between the lip and the lip substrate toward the corners 122 of the wearer's mouth.

Turning now to FIG. 8 for illustration, in preferred embodiments, the upper lip substrate 32 comprises an upper image layer 106 adapted to produce an upper image viewable from a viewing position outward of the upper second face 36 when the upper guide layer 42 is released therefrom. Turning to FIG. 9, correspondingly, the lower lip substrate 62 may comprise a lower image layer 110 adapted to produce a lower image viewable from a viewing position outward of the lower second face 66 when the lower guide layer 72 is released therefrom. It is typical for the entire lip substrate, including the respective image layer, to consist essentially of one or more ink layers which have been printed, for example, onto the bond face of the respective guide layer.

In certain embodiments, the upper lip substrate 32 comprises an upper color barrier 114 between the upper image layer 106 and the upper first face 34. The upper color barrier 114 may be adapted to substantially block the color of the upper lip 130 of a wearer from being viewable from a viewing position outward of the upper second face 36 when the upper guide layer 42 is released therefrom. Similarly, the lower lip substrate 62 may comprise a lower color barrier 116 between the lower image layer 110 and the lower first face 64. The lower color barrier 116 is adapted to substantially block the color of the lower lip 132 of a wearer from being viewable from a viewing position outward of the lower second face 66 when the lower guide layer 72 is released therefrom. The color barriers may be a thin layer of opaque white ink.

Applicants have determined that the upper and lower color barriers can be printed thinly enough such that, prior to application of the lip substrate to the lip of a wearer, the image layer is largely viewable through the color barrier from a viewing position outward of the first face of the lip substrate. Because the color barrier is printed while the lip substrate is in its fully expanded form, and because the lip substrate is applied to the lip while the lip is in substantially expanded form (e.g., while the mouth is in open dropped jaw configuration), the color barrier becomes even more opaque, and therefore more effective, as the lips return to their normal relaxed state (generally as a result of the contraction of the lip substrate along with the lip to which it has been applied).

Referring again to FIG. 8 for illustration, in preferred embodiments, the upper image layer 106 may extend laterally substantially throughout (i.e., in a direction substantially as indicated at 118) the upper lip substrate 32. Likewise, as illustrated in FIG. 9, for example, the lower image layer 110 may extend laterally substantially throughout the lower lip substrate 62. It is presently envisioned that the lip substrates may each comprise layers in addition to or other than the image layers and color barrier layers described herein. For example, a substantially transparent protective gloss layer may be included in the lip substrates between the respective image layer and second face. In addition to possibly providing an enduring gloss effect for the wearer, such a layer might also, for example, provide further protection against gradual erosion of certain materials and colors present within the image layers as the wearer engages in eating, drinking, kissing or the like.

In particular embodiments, glitter particles may be suspended generally within the respective adhesive layer. In such embodiments, the respective lip substrate may be substantially transparent, allowing the glitter particles to be viewable from a viewing position outward of the second face when the guide layer is released therefrom. With the lip substrate acting largely as a substantially clear protective layer, this approach may provide for a longer-lasting, more comfortable and more attractive appearance of glittered lips while preventing the glitter particles from wearing away or presenting an undesirable rough outer surface. In a method for applying such glittered embodiments, among other embodiments, it may be preferred to position the mouth of the wearer in a relaxed "O" or "oooh" configuration as opposed to, for example, an "ahh" configuration, in order to produce a more optimal applied result.

Figure 14:
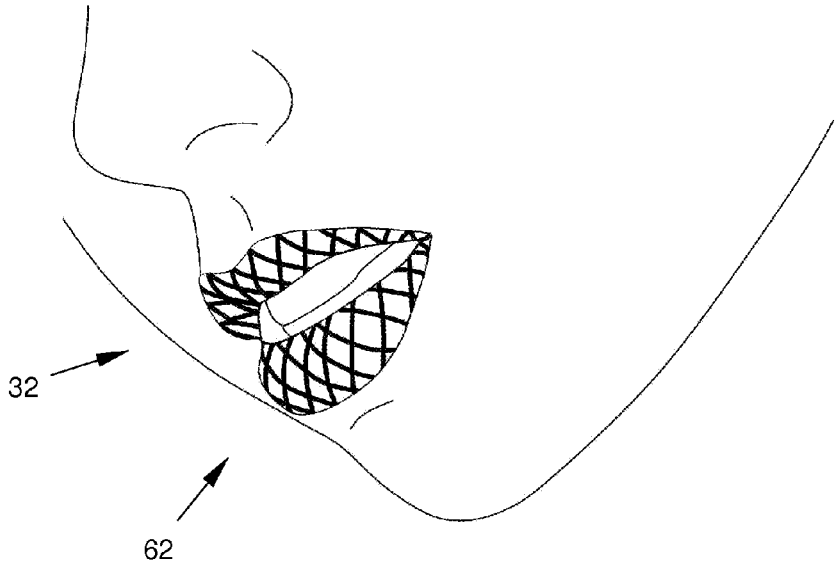
FIG. 14 is a diagrammatic perspective view of a mouth of a wearer in a relaxed configuration, in which an upper and lower lip substrate has been applied to the upper and lower lips, respectively.

In embodiments, the upper image and lower image may be, for example, substantially one or more of the following: metallic, glittered, homogeneously colored or fluorescent. Combinations of these characteristics are envisioned as well. Further, in certain embodiments, the upper image and lower image may comprise a graphic pattern selected from the group consisting of fishnet, lace, polka dots, checkerboard, leopard skin, tiger stripes, zebra stripes, snakeskin, rainbow and skull & crossbones. These patterns can incorporate any of a number of color variations as well. In addition, at least one of the upper image and lower image may include text. The wearer depicted in FIG. 14, for example, is shown having applied an upper lip substrate 32 and a lower lip substrate 62 in which the upper and lower images comprise a fishnet graphic pattern.

In most preferred embodiments, the upper peel layer 40 and lower peel layer 70 are generally light permeable such that the upper image and lower image, respectively, are substantially visible therethrough. In many cases, the peel layers are made of a transparent film.

In certain embodiments, the upper adhesive layer 38 and lower adhesive layer 68 may contain a substance for delivery of the substance to the tissue of the lips of a wearer of the upper lip substrate 32 and lower lip substrate 62. This substance may be, for example, selected from the group consisting of a moisturizer, a vitamin, a pharmaceutical and nicotine. By way of example, applicants have determined that a quantity of vitamin E can be added to the adhesive layers without significantly affecting their performance.

Figure 12:
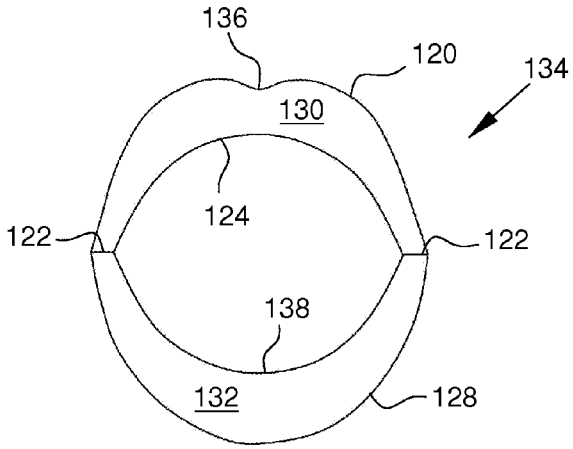
FIG. 12 is a diagrammatic front view of a mouth of a wearer in an open dropped-jaw configuration.
Figure 13:
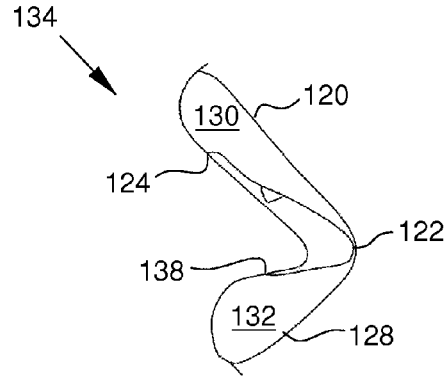
FIG. 13 is a diagrammatic side view of a mouth of a wearer in an open dropped-jaw configuration.

A method for applying an upper lip substrate 32 to the upper lip 130 of a wearer may comprise one or more of the following steps:

selecting an upper applicator 22 as described, for example, herein;

positioning the mouth of the wearer 134 in an open dropped jaw configuration (shown, for example, in FIGS. 12 and 13, and which may be otherwise known as an "ahh" configuration, and in embodiments of the method, an "O" or "ooh" configuration);

aligning the upper edge 24 with the upper vermilion border 120 of the upper lip 130;

positioning the upper peel layer 40 of the upper applicator 22 against the upper lip 130;

referencing the upper guide pattern with respect to the corners 122 and upper waterline 124 of the mouth of the wearer, thereby identifying excess portions 126 of the upper applicator 22;

trimming the excess portions 126 from the upper applicator 22;

peeling the upper peel layer 40 away from the upper adhesive layer 38;

sticking the upper lip substrate 32 to the upper lip 130 by way of the upper adhesive layer 38 while the mouth of the wearer 134 is in the open dropped-jaw configuration;

applying water to the upper guide layer 46 (by way of, for example, a small sponge);

releasing the upper guide layer 42 from the upper second face 36 such that the upper lip substrate 32 remains on the upper lip by way of the upper adhesive layer 38.

wetting the upper lip substrate 32 following the step of releasing; and smoothing out any creases in the upper lip substrate 32 following the step of wetting.

A method for producing a lip substrate applicator may comprise one or more of the following steps:

providing a guide layer having a bond face and a guide face;

marking a guide pattern on the guide face, the guide pattern being arranged along a pathway which is substantially symmetrical and curved;

printing a substrate onto the bond face, the substrate having a first face and a second face, the second face being directly adjacent the bond face;

applying an adhesive layer to the first face;

covering the adhesive layer with a peel layer; and die-cutting through the guide layer, said lip substrate, the adhesive layer and the peel layer, thereby forming an applicator being flexible and having an edge (as shown, for example, at 24 or 54) and an opposing waterline edge (as shown, for example, at 84 or 86), each extending between a right end and a left end, the edge being generally arcuate, substantially symmetrical about an axis, and having a concave portion substantially symmetrical about the axis, the waterline edge being generally arcuate in the same direction as said edge.

In certain methods of producing a lip substrate applicator, the step of printing may be performed by way of offset printing, and the step of applying may performed by way of screen printing. In particular methods, the step of applying may be performed by way of screen printing such that the adhesive layer has a thickness which is greater proximate the left end and said right end than proximate said axis. In the same or alternate methods, the adhesive layer may contain glitter particles suspended therein, and at least a portion of the substrate may be substantially transparent, thereby allowing at least a portion of the glitter particles to be viewable through the lip substrate from a position outward of the second face with the guide layer removed therefrom.

In certain embodiments of the method for producing lip substrate applicator, the step of printing is performed by way of offset printing (typically at high resolutions such as 300 dpi or greater). Further, the step of applying the adhesive layer may be performed by way of screen printing (for example, at 180 holes/square inch). In further such embodiments, the step of applying may be performed by way of screen printing such that the adhesive layer has a thickness which is greater proximate the left end and the right end than proximate the axis. By way of example, the portions of the adhesive layer at the outer ⅓ of the applicator may be applied at 160 holes/square inch, rather than the 180 holes/square inch, thereby resulting in a greater adhesive thickness at those locations.

Applicators and methods in accordance with the present invention are designed to provide a wearer with an inexpensive yet novel lip cosmetic which grabs attention, lasts for 4-8 hours, does not smudge or stain, is easy to apply and remove, and is customizable to fit just about any size lips.

Terms such as "upper" and "lower" are frequently used in connection with certain features within the description and claims presented herein. Where such features are discussed or claimed herein without the terms "upper" or "lower," it is meant to signify that such features can pertain to respective features of an upper applicator or a lower applicator.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A lip substrate applicator kit comprising:

(a) an upper applicator being flexible and having an upper edge extending between an upper right end and an upper left end, said upper edge being generally arcuate and substantially symmetrical about an upper axis, said upper applicator including:

(i) an upper lip substrate having an upper first face and an upper second face;

(ii) an upper adhesive layer disposed generally at said upper first face;

(iii) an upper peel layer peelably affixed to said upper adhesive layer; and (iv) an upper guide layer having an upper bond face and an upper guide face, said upper bond face being releasably bonded to said upper second face such that said upper guide layer is releasable from said upper second face upon application of water to said upper guide layer, said upper guide face including an upper guide pattern visibly defining a multiplicity of curved upper trim paths extending from proximate said upper right end to proximate said upper left end for aiding a user in evenly trimming said upper applicator generally along a selected one of said curved upper trim paths, each of said curved upper trim paths being substantially symmetrical about said upper axis and curved in the same direction as said upper edge; and (b) a lower applicator being flexible and having a lower edge extending between a lower right end and a lower left end, said lower edge being generally arcuate and substantially symmetrical about a lower axis, said lower applicator including:

(i) a lower lip substrate having a lower first face and a lower second face, (ii) a lower adhesive layer disposed generally at said lower first face;

(iii) a lower peel layer peelably affixed to said lower adhesive layer; and (iv) a lower guide layer having a lower bond face and a lower guide face, said lower bond face being releasably bonded to said lower second face such that said lower guide layer is releasable from said lower second face upon application of water to said lower guide layer, said lower guide face including a lower guide pattern visibly defining a multiplicity of curved lower trim paths extending from proximate said lower right end to proximate said lower left end for aiding said user in evenly trimming said lower applicator generally along a selected one of said curved lower trim paths, each of said curved lower trim paths being substantially symmetrical about said lower axis and curved in the same direction as said lower edge.

2. A lip substrate applicator kit as defined in claim 1 in which said upper edge has a concave portion substantially symmetrical about said upper axis.

3. A lip substrate applicator kit as defined in claim 1 in which:

(a) said upper lip substrate, said upper adhesive layer and said upper guide layer each have outermost lateral perimeters which are substantially identical in shape and size, and which are in substantial alignment with each other; and (b) said lower lip substrate, said lower adhesive layer and said lower guide layer each have outermost lateral perimeters which are substantially identical in shape and size, and which are in substantial alignment with each other.

4. A lip substrate applicator kit as defined in claim 1 in which:

(a) said upper applicator has an upper waterline edge disposed generally opposite said upper edge and extending between said upper right end and said upper left end, said upper waterline edge being generally arcuate in the same direction as said upper edge; and (b) said lower applicator has a lower waterline edge disposed generally opposite said lower edge and extending between said lower right end and said lower left end, said lower waterline edge being generally arcuate in the same direction as said lower edge.

5. A lip substrate applicator kit as defined in claim 1 in which said curved upper trim paths and said curved lower trim paths are comprised of broken lines.

6. A lip substrate applicator kit as defined in claim 1 further comprising a die cut applicator sheet, said upper applicator and said lower applicator each being die cut and suspendedly detachable therefrom.

7. A lip substrate applicator kit as defined in claim 1 further comprising a die cut applicator sheet, a multiplicity of said upper applicators and a multiplicity of said lower applicators, said upper applicators and said lower applicators each being die cut and suspendedly detachable from said die cut applicator sheet.

8. A lip substrate applicator kit as defined in claim 1 in which each of said adhesive layers have an adhesive thickness, said adhesive thicknesses being greater proximate respective said right ends and left ends than proximate respective said axes.

9. A lip substrate applicator kit as defined in claim 1 in which:

(a) said upper lip substrate comprises an upper image layer adapted to produce an upper image viewable from a viewing position outward of said upper second face when said upper guide layer is released therefrom; and (b) said lower lip substrate comprises a lower image layer adapted to produce a lower image viewable from a viewing position outward of said lower second face when said lower guide layer is released therefrom.

10. A lip substrate applicator kit as defined in claim 9 in which:

(a) said upper lip substrate comprises an upper color barrier between said upper image layer and said upper first face, said upper color barrier being adapted to substantially block the color of the upper lip of a wearer from being viewable from said viewing position outward of said upper second face when said upper guide layer is released therefrom; and (b) said lower lip substrate comprises a lower color barrier between said lower image layer and said lower first face, said lower color barrier being adapted to substantially block the color of the lower lip of a wearer from being viewable from said viewing position outward of said lower second face when said lower guide layer is released therefrom.

11. A lip substrate applicator kit as defined in claim 9 in which said upper image layer extends laterally substantially throughout said upper lip substrate and said lower image layer extends laterally substantially throughout said lower lip substrate.

12. A lip substrate applicator kit as defined in claim 9 in which said upper image and said lower image are substantially metallic.

13. A lip substrate applicator kit as defined in claim 9 in which said upper image and said lower image are substantially glittered.

14. A lip substrate applicator kit as defined in claim 9 in which said upper image and said lower image are substantially homogeneously colored.

15. A lip substrate applicator kit as defined in claim 9 in which said upper image and said lower image are substantially fluorescent.

16. A lip substrate applicator kit as defined in claim 9 in which said upper image and said lower image comprise a graphic pattern selected from the group consisting of fishnet, lace, polka dots, checkerboard, leopard skin, tiger stripes, zebra stripes, snakeskin, rainbow and skull & crossbones.

17. A lip substrate applicator kit as defined in claim 9 in which said upper peel layer and said lower peel layer are generally light permeable such that said upper image and said lower image are respectively substantially visible therethrough.

18. A lip substrate applicator kit as defined in claim 9 in which at least one of said upper image and said lower image includes text.

19. A lip substrate applicator kit as defined in claim 1 in which said upper adhesive layer and said lower adhesive layer contain a substance for delivery of said substance to the tissue of the lips of a wearer of said upper lip substrate and said lower lip substrate.

20. A lip substrate applicator kit as defined in claim 19 in which said substance is selected from the group consisting of a moisturizer, a vitamin, a pharmaceutical and nicotine.

21. A lip substrate applicator kit as defined in claim 1 in which at least one of said upper adhesive layer and said lower adhesive layer contains glitter particles.

22. A lip substrate applicator kit as defined in claim 1 in which said upper adhesive layer and said lower adhesive layer each contain glitter particles, and at least a portion of each of said upper lip substrate and said lower lip substrate is substantially transparent, thereby allowing at least a portion of respective said glitter particles to be viewable through the respective said lip substrates from a position outward of said upper second face and said lower second face when the upper guide layer and lower guide layer are removed respectively therefrom.

23. A lip substrate applicator kit comprising:

(a) an upper applicator being flexible and having an upper edge and an opposing upper waterline edge, each of which extends between an upper right end and an upper left end, said upper edge being generally arcuate, substantially symmetrical about an upper axis and having a concave portion substantially symmetrical about said upper axis, said upper waterline edge being generally arcuate in the same direction as said upper edge, said upper applicator including:

(i) an upper lip substrate having an upper first face and an upper second face;

(ii) an upper adhesive layer disposed generally at said upper first face;

(iii) an upper peel layer peelably affixed to said upper adhesive layer; and (iv) an upper guide layer having an upper bond face and an upper guide face, said upper bond face being releasably bonded to said upper second face such that said upper guide layer is releasable from said upper second face upon application of water to said upper guide layer, said upper guide face including an upper guide pattern visibly defining a multiplicity of curved upper trim paths extending from proximate said upper right end to proximate said upper left end, each of said curved upper trim paths being substantially symmetrical about said upper axis and curved in the same direction as said upper edge;

(b) a lower applicator being flexible and having a lower edge and a lower waterline edge, each of which extends between a lower right end and a lower left end, said lower edge being generally arcuate and substantially symmetrical about a lower axis, said lower waterline edge being generally arcuate in the same direction as said lower edge, said lower applicator including:

(i) a lower lip substrate having a lower first face and a lower second face, (ii) a lower adhesive layer disposed generally at said lower first face;

(iii) a lower peel layer peelably affixed to said lower adhesive layer; and (iv) a lower guide layer having a lower bond face and a lower guide face, said lower bond face being releasably bonded to said lower second face such that said lower guide layer is releasable from said lower second face upon application of water to said lower guide layer, said lower guide face including a lower guide pattern visibly defining a multiplicity of curved lower trim paths extending from proximate said lower right end to proximate said lower left end, each of said curved lower trim paths being substantially symmetrical about said lower axis and curved in the same direction as said lower edge; and (c) a die cut applicator sheet, said upper applicator and said lower applicator each being die cut and suspendedly detachable therefrom.

* * * * *